US007281282B2

(12) United States Patent
Huber

(10) Patent No.: US 7,281,282 B2
(45) Date of Patent: Oct. 16, 2007

(54) FOOT TENT APPARATUS

(76) Inventor: Paul E. Huber, 9087 S. Wasatch Blvd., Salt Lake City, UT (US) 84093

( * ) Notice: Subject to any disclaimer, the term of this patent is extended or adjusted under 35 U.S.C. 154(b) by 0 days.

(21) Appl. No.: 11/121,701

(22) Filed: May 3, 2005

(65) Prior Publication Data

US 2006/0248647 A1 Nov. 9, 2006

(51) Int. Cl.
*A47C 21/02* (2006.01)

(52) U.S. Cl. ..... 5/505.1; 5/506.1; 5/504.1

(58) Field of Classification Search ..... 5/504.1, 5/505.1, 506.1
See application file for complete search history.

(56) References Cited

U.S. PATENT DOCUMENTS

| | | | | |
|---|---|---|---|---|
| 951,618 | A | 3/1910 | Peerstone | |
| 2,598,295 | A | 5/1952 | Pelton | |
| 2,607,933 | A | 8/1952 | Fulton | |
| 2,676,340 | A * | 4/1954 | Garriott et al. | 5/505.1 |
| 2,710,414 | A | 6/1955 | Emery | |
| 2,750,604 | A | 6/1956 | Gold | |
| 3,808,614 | A | 5/1974 | Reinhard | |
| 4,214,327 | A | 7/1980 | Smith | |
| 4,975,997 | A | 12/1990 | Misiura et al. | |
| 5,175,899 | A | 1/1993 | Lou | |
| 5,203,042 | A * | 4/1993 | Mason | 5/504.1 |
| 5,329,658 | A | 7/1994 | Fontenot et al. | |
| D352,847 | S | 11/1994 | Station | |
| 5,438,720 | A | 8/1995 | Daneshvar | |
| 5,881,406 | A * | 3/1999 | Cobb | 5/505.1 |
| 6,163,901 | A | 12/2000 | Sargent | |
| 6,240,581 | B1 | 6/2001 | Pender | |
| 6,711,767 | B2 | 3/2004 | Klamm | |
| 6,834,403 | B1 | 12/2004 | Elliott | |
| 2003/0229942 | A1 | 12/2003 | Dilascio | |

* cited by examiner

*Primary Examiner*—Patricia Engle
*Assistant Examiner*—Jonathan Liu
(74) *Attorney, Agent, or Firm*—Clayton Howarth & Cannon, P.C.

(57) ABSTRACT

A device for supporting blankets on a bed, for creating a space to provide room for a person's feet to be unconstricted and unbothered by the weight of the blankets. The device may include a base member for positioning between a mattress and box springs in a conventional bed. A pair of side supports may be joined to the base member on opposite sides of the bed. The side supports may include telescoping members that may be adjusted in length and locked in place in raised or lowered positions. A rail may be joined to the side supports to extend across the bed such that blankets on the bed may be draped over the rail. When the side supports are in a raised position, a space may be provided for the persons feet, whereas when the side supports are lowered, the device may be virtually undetectable under the blankets.

16 Claims, 5 Drawing Sheets

FOOT TENT APPARATUS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

1. The Field of the Invention

The present disclosure relates generally to bedding accessories, and more particularly, but not necessarily entirely, to a device for supporting covers on a bed in an elevated position.

2. Description of Related Art

Some people have trouble sleeping comfortably, especially during the winter months, due to the weight of bed covers, including blankets, comforters, sheets and the like on their feet. Also, the restriction on movement that is associated with such weight and contact with bed covers may cause discomfort. Moreover, some people who may be bedridden for extended periods of time may develop sores on their toes or heels due to pressure and contact caused by bed covers.

Numerous attempts have been made in the prior art to resolve the problems caused by the pressure of bed covers. Despite the advantages of known blanket support devices, there is a need for a device for supporting bed covers in an elevated position that is simple in design, manufacture and operation. There is also a need for such a device for supporting bed covers that may be adjustable along the length of the bed such that bed covers may be elevated at different locations to be useful for people of different heights or for use in elevating the bed covers over different portions of the body. There is also a need for a device for supporting bed covers that may be easily adjusted over a wide range of upward positions. There is also a need for such a device for supporting bed covers that may be unobtrusive such that the device may be substantially hidden from view when not in use.

The prior art is characterized by several disadvantages that are addressed by the present disclosure. The present disclosure minimizes, and in some aspects eliminates, the above-mentioned failures, and other problems, by utilizing the methods and structural features described herein.

The features and advantages of the disclosure will be set forth in the description which follows, and in part will be apparent from the description, or may be learned by the practice of the disclosure without undue experimentation. The features and advantages of the disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
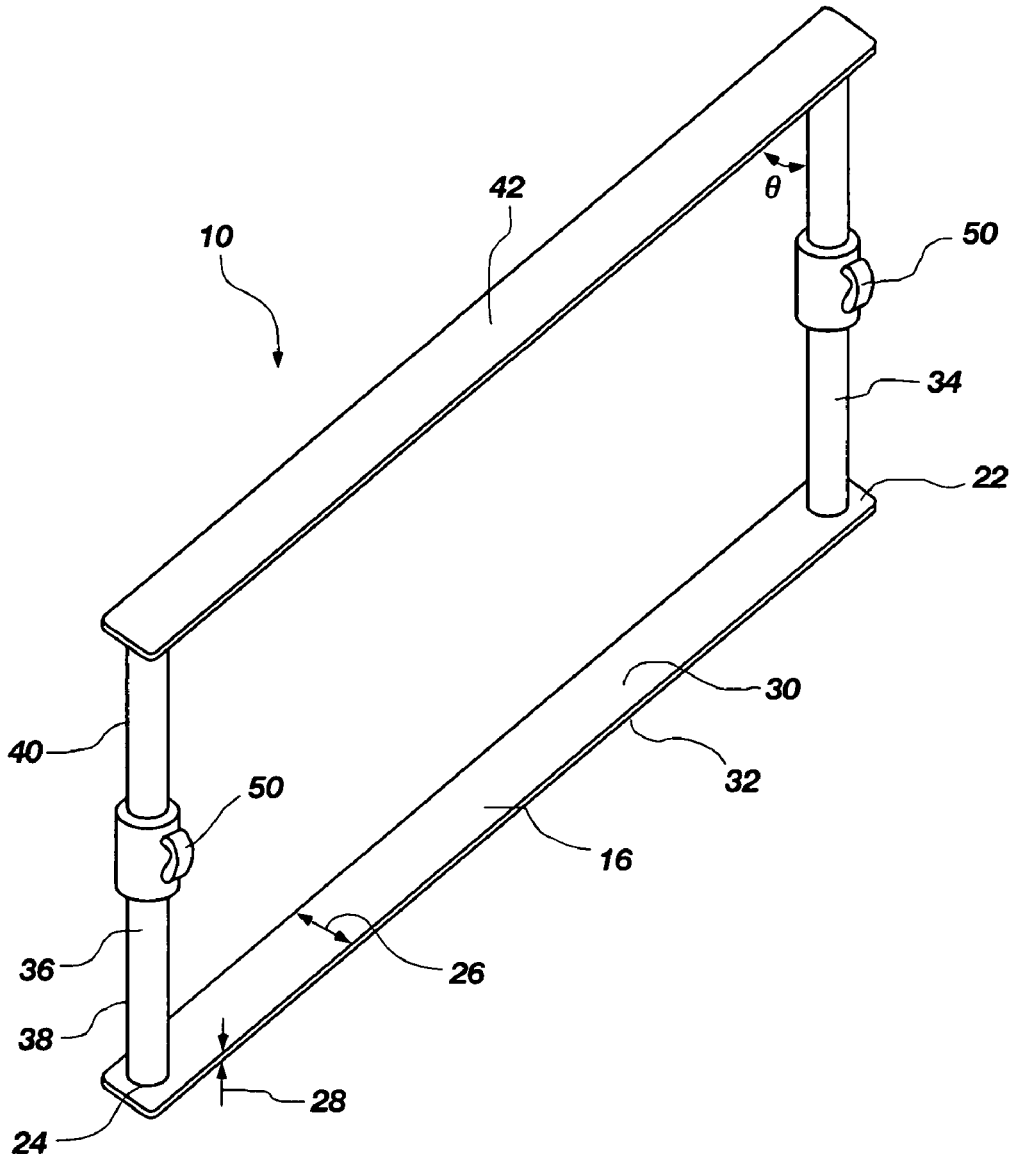
FIG. 1 is a perspective view of a device for supporting covers on a bed.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

It must be noted that, as used in this specification and the appended claims, the singular forms "a," "an," and "the" include plural referents unless the context clearly dictates otherwise. Moreover, in describing and claiming the present disclosure, the following terminology will be used in accordance with the definitions set out below.

As used herein, the terms "comprising," "including," "containing," "characterized by," and grammatical equivalents thereof are inclusive or open-ended terms that do not exclude additional, unrecited elements or method steps.

As used herein, the phrase "consisting essentially of" and grammatical equivalents thereof limit the scope of a claim to the specified materials or steps and those that do not materially affect the basic and novel characteristic or characteristics of the claimed disclosure.

As used herein, the term bed "cover" or "covers" shall be construed broadly to include any variety of overlay, including blankets, comforters, sheets and the like.

Figure 2:
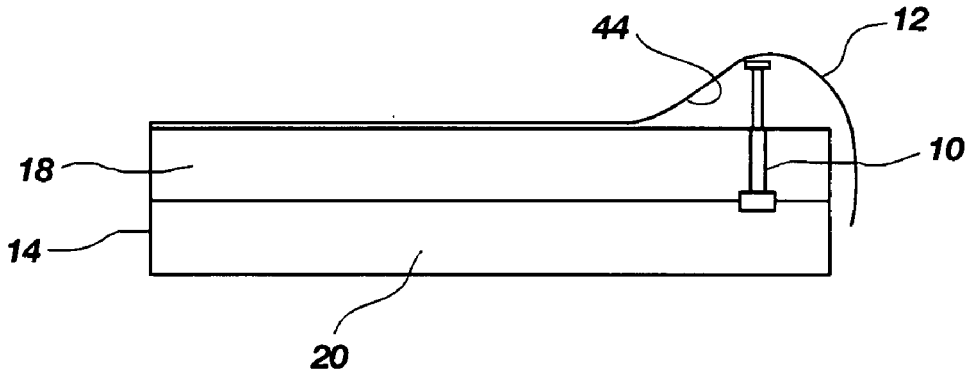
FIG. 2 is a side view of a bed and the device of FIG. 1, for supporting covers on the bed, with the device in a raised position.
Figure 3:
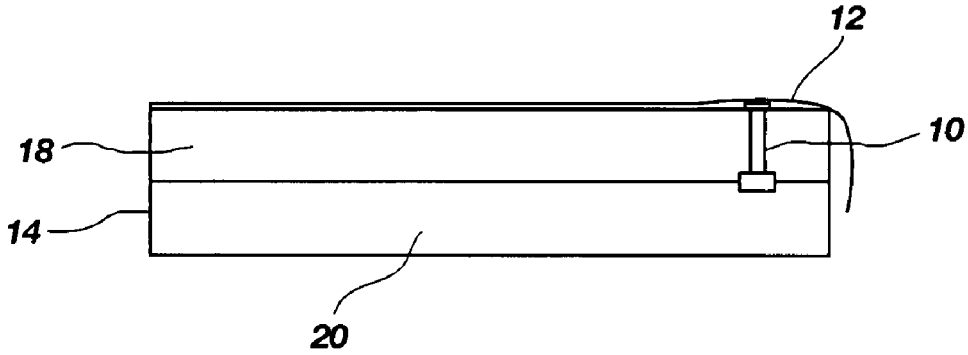
FIG. 3 is a side view of a bed and the device of FIG. 1, for supporting covers on the bed, with the device in a lowered position.

Referring now to FIG. 1, a perspective view is shown of a device, indicated generally at 10, for supporting covers 12 on a bed 14 as shown in FIGS. 2 and 3. The device 10 may also sometimes be referred to herein as a foot tent apparatus. The device 10 may include a base member 16 configured to be positioned between a mattress 18 and box springs 20 of the bed 14. It will be understood that in some embodiments, the mattress 18 may be placed on a support surface other than box springs 20, such that the base 16 need not necessarily be disposed on box springs 20. Moreover, in other embodiments, the base 16 may be positioned under other structures besides the mattress 18 within the scope of the present disclosure.

The base 16 may be formed as a flattened or non-round bar having a first end 22 configured to be positioned on a first side of the bed 14, and a second end 24 configured to be positioned on a second side of the bed 14. Accordingly, the base 16 may have a length that is configured to have a greater dimension than a width of the bed 14 so that the first end 22 and the second end 24 of the base 16 extend beyond opposite sides of the bed 14. The flattened configuration of the base 16 may provide stability to facilitate supporting the device 10 in an upright orientation without rolling due to the forces applied by the covers 12. Accordingly, the base 16 may have a lateral dimension 26 that may be greater than an upward dimension 28. One embodiment of the base 16 may include a substantially flat upper surface 30 and a substantially flat lower surface 32. The base 16 may be formed as a one-piece rigid member having a fixed length. Accordingly, a different sized base 16 may be provided for different sized beds 14. Alternatively, the base 16 may be formed as a multi-piece member capable of being adjusted in length.

Figure 8:
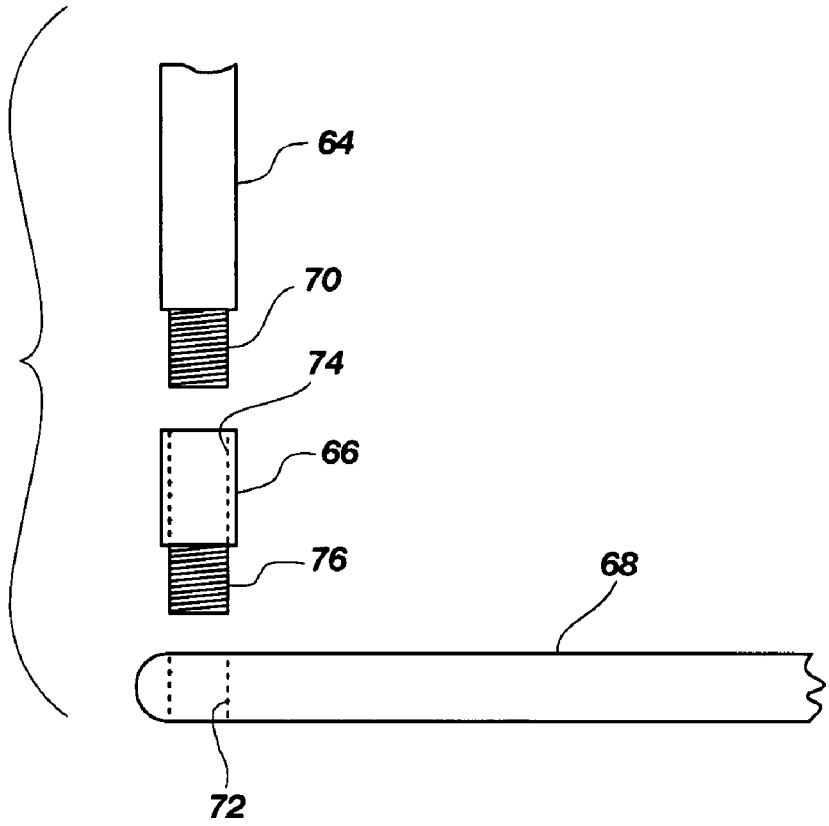
FIG. 8 is an exploded side break-away view of an alternative embodiment side support and base member.

A first side support 34 may be joined to the first end 22 of the base member 16 and a second side support 36 may be joined to the second end 24 of the base member 16. In one embodiment of the present disclosure, the first side support 34 and the second side support 36 may be fixedly attached to the base member 16 so as to be non-rotatable or pivotal with respect to the base member 16. However, it will be understood that other embodiments of the present disclosure may include the first side support 34 and the second side support 36 removably, or movably attached to the base member 16, as shown in FIG. 8 and discussed more fully below, for example.

The first side support 34 and the second side support 36 may each be formed as telescoping members capable of extending to an increased length in an upward direction, and retracting to a decreased length. Accordingly, the first side support 34 and the second side support 36 may be formed as multi-part members that may be configured such that at least one of the parts may be sized and shaped to fit within at least one of the other parts. For example, as shown in FIG. 1, the first side support 34 and the second side support 36 may each include a lower portion 38 and an upper portion 40 in which the lower portion 38 is configured to receive the upper portion 40 in an interior thereof. It will also be understood that the first side support 34 and the second side support 36 may alternatively be formed such that the lower portion 38 may be configured to be received within the upper portion 40, and that additional portions, such as three or more telescoping portions, may be used within the scope of the present disclosure.

Another embodiment within the scope of the present disclosure may include a first side support 34 and a second side support 36 that may extend through openings in the base member 16 such that a bottom of the upper portion 40 may extend below the base member 16 to provide for a greater range of motion of the first side support 34 and second side support 36. Other embodiments may be configured such the all portions of the first side support 34 and the second side support 36 may be prevented from extending beyond the base member 16.

As shown most clearly in FIGS. 1 and 4-6, the first side support 34 and the second side support 36 may each comprise a locking mechanism 50, also sometimes referred to herein as a locking means for locking a support structure. The locking mechanism 50 may include a lever 52 that may be pivotally attached to a brace member 54, which may be attached to one of the lower portion 38 or upper portion 40 of at least one of the first side support 34 or the second side support 36. The lever 52 may include a cam surface 56 for contacting a grip member 58. The grip member 58 may be movably disposed in a cavity in the brace member 54 and may include a gripping surface 60 for contacting the upper portion 40 of the first side support 34 or the second side support 36 for locking the upper portion 40 with respect to the lower portion 38. The grip member 58 may be formed of any material known in the art for providing suitable gripping characteristics, such as plastic, rubber, or metal materials, for example.

Figure 4:
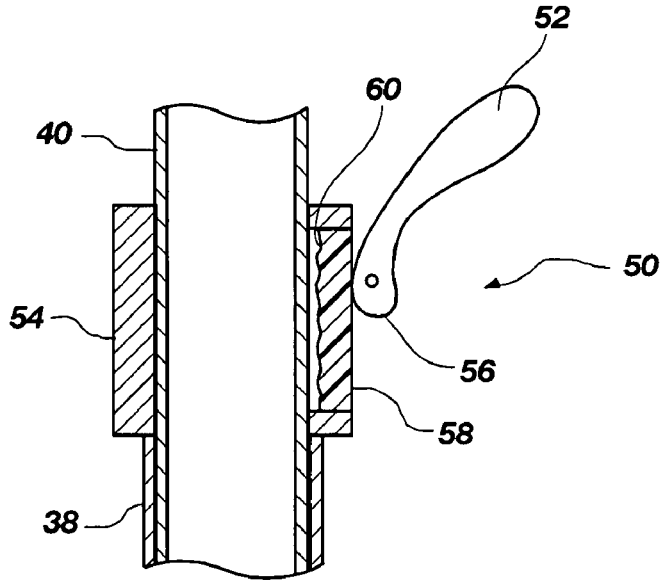
FIG. 4 is a side, break-away cross-sectional view of a locking mechanism for the device of FIG. 1, with the device in an unlocked position.
Figure 5:
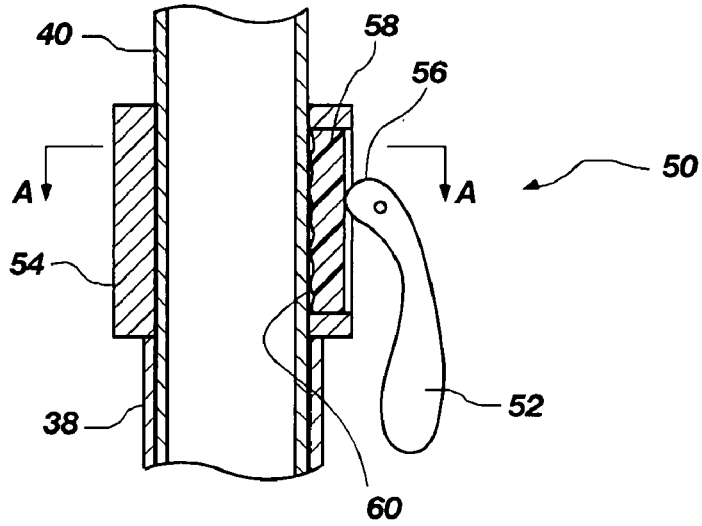
FIG. 5 is a side, break-away cross-sectional view of a locking mechanism for the device of FIG. 4, with the device in a locked position.
Figure 6:
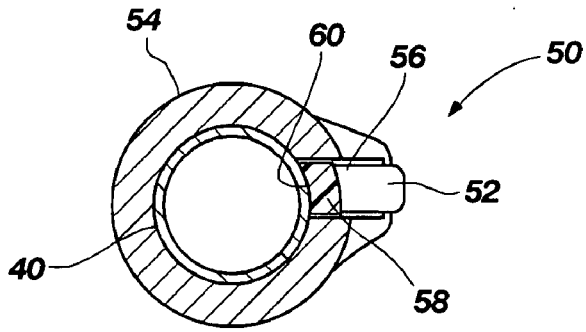
FIG. 6 is a top cross-sectional view of the locking mechanism of FIG. 5 taken along line A-A.

As shown most clearly in FIG. 4, when the lever 52 is in an unlocked position, the cam surface 56 may be shaped to provide space for the grip member 58 to move such that a locking force may not be applied on the upper portion 40, and the upper portion 40 may be free to move with respect to the lower portion 38. However, as the lever 52 is pivoted to a locked position, as shown most clearly in FIGS. 5 and 6, the cam surface 56 may contact the grip member 58 to force the grip member 58 into contact with the upper portion 40 to thereby lock the upper portion 40 in place. Accordingly, the first side support 34 and the second side support 36 may be adjustable and lockable in an infinite number of positions.

In alternative embodiments, the cam surface 56 of the lever 52 may contact the upper portion 40 directly, without an intervening grip member 58. Similarly, it will be understood that the upper portion 40 and the lower portion 38 may be reversed such that the grip member 58 may engage with the lower portion 38. Moreover, other alternative embodiments may include a rotatable locking mechanism (not shown) in which a threaded sleeve may be engaged with external threads on a side support. The locking mechanism may also include a cylindrical member having one or more slots such that a side wall of the cylindrical member forms deflectable flanges. As the sleeve is rotated, engagement of the threads may cause the sleeve to move along a length of the side support. The sleeve may have a tapered portion that may engage with the deflectable flanges to thereby press the flanges against the side support and lock the side support in a desired position. Additional alternative embodiments of the locking mechanism may include pins receivable in openings in the side support, or ratchets engageable with teeth on the side support. Accordingly, it will be understood that various different kinds of locking mechanisms may be used to lock the first side support 34 and the second side support 36 in place, within the scope of the present disclosure.

A rail 42 may be joined to the first side support 34 and the second side support 36, as shown in FIG. 1. The rail 42 may be configured to reside above the mattress 18 and under the covers 12 on the bed 14 for supporting the covers 12 above the bed 14. The rail 42 may be formed as an elongate member with a length similar to that of the base 16. In one embodiment, the rail 42 may be fixedly attached to the first side support 34 and the second side support 36 so as to be non-moveable with respect to the upper portion 40 of the first side support 34 and the second side support 36. Other embodiments of the present disclosure may include a rail 42 that may be removably attached to the first side support 34 and the second side support 36, or that may be hingedly attached to the first side support 34 and the second side support 36. The hinged connection may allow an angle θ between the rail 42 and the first side support 34 and the second side support 36 to be adjustable. Accordingly, the first side support 34 may be placed in a lowered position and the second side support 36 may be placed in an raised position, or vice versa, without causing stress on the rail 42 or the first side support 34 and the second side support 36.

The rail 42 may be formed as a relatively flat member such that when the rail 42 is placed on the mattress 18, the rail 42 may be unobtrusive and substantially undetectable under the covers 12. Moreover, the rail 42 formed as a flat member may contact the covers 12 to provide a larger space 44 (see FIG. 2) between the covers 12 and the mattress 18 as compared to round rails. The rail 42 and the base member 16 may be padded and/or covered with a low friction material, such as silk, to permit the base member 16 to slide between the mattress 18 and box springs 20 and for covers 12, such as sheets and blankets to slide over the rail 42.

In use, the base member 16 may be positioned between the mattress 18 and the box springs 20 in a conventional bed 14. The device 10 may then be slid along a length of the bed 14 to a desired position. In some uses of the device 10, it may be desirable to position the device 10 where a person's feet may be located. However, it will be understood that the device 10 may be positioned at any desired location along the length of the bed 14. Moreover, since people have different heights, or may desire to sleep at different locations on the bed 14, it may be desirable to adjust the position of the device 10 with respect to the length of the bed 14 to correspond with a desired position of the device 10. It may also be desirable in some instances to place the device 10 at an angle with respect to the length of the bed 14 so that the device 10 may be positioned at a suitable location for a tall person on one side of the bed 14 and a shorter person on the other side of the bed 14.

The rail 42 may be positioned over the mattress 18, which may typically be covered with a bottom sheet or other covering. Covers 12, typically including a top sheet and blanket, for example, may then be draped or otherwise placed over the top of the rail 42. The rail 42 may be lifted such that the first side support 34 and the second side support 36 are lengthened to a desired height and the locking mechanism 50 may be actuated by rotating the lever 52 to lock the first side support 34 and the second side support 36 in position. The space 44 may thereby be created between the mattress 18 and the covers 12, including the top sheet and blankets, for example, as best shown in FIG. 2. This space 44 may provide room for a person's feet to be unconstricted and unbothered by the weight of the covers 12.

When the device 10 is not in use, the locking mechanism 50 may be actuated to release and shorten the first side support 34 and the second side support 36 to allow the rail 42 to be lowered to rest on the mattress 18, as best shown in FIG. 3. In the lowered position, the space 44 may be practically non-existent and the device 10 may be substantially undetectable. In some instances, it may be desirable to press the rail 42 against the mattress 18 and lock the rail 42 in place to thereby allow the rail 42 to remain depressed in the mattress 18 so that the rail 42 may be less visible on the surface of the bed 14 when the covers 12 are placed over the rail 42. The rail 42 may be raised to allow access to the bottom sheet such that the device 10 may not impede changing the sheets and making the bed 14.

It will be understood that in one embodiment of the present disclosure, the device 10 may form a substantially rectangular perimeter or frame defining an enclosed space for receiving at least a portion of the bed 14, such as the mattress 18, there through. The substantially rectangular perimeter may be defined by the base member 16, the first side support 34, the second side support 36 and the rail 42. The dimensions of the substantially rectangular perimeter may be altered by adjusting the first side support 34 and the second side support 36 as previously discussed.

Figure 7:
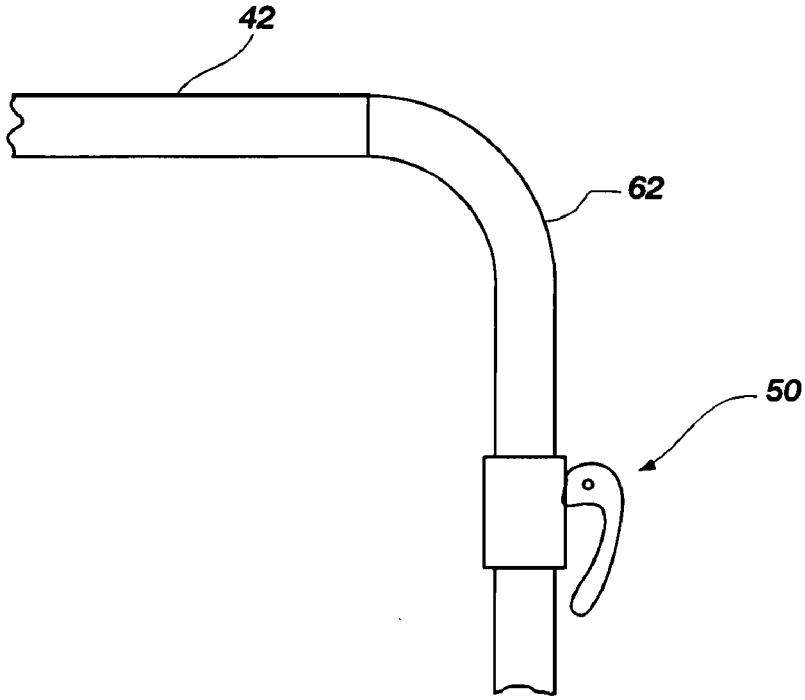
FIG. 7 is a break-away side view of an alternative embodiment side support.

Referring now to FIG. 7, a break-away side view is shown of an alternative embodiment side support 62. It will be understood that the alternative embodiment side support 62 may be similar to the previously discussed side supports, except that the alternative embodiment side support 62 may be curved so as to be joined with an end of the rail 42. It will be understood that the curved configuration of the alternative embodiment side support 62 may conform more closely with the shape of the mattress 18 such that the device 10 may be less visible in a lowered position. Alternatively, it will be understood that the rail 42 may include the curved shape rather than the side support 62, or that a one piece rail and side support may be provided with a curved shape to correspond with the shape of the mattress 18 within the scope of the present disclosure. Moreover, other embodiments may include angled corners or other shaped corners to correspond with the shape of a particular mattress 18.

Referring now to FIG. 8, an exploded side break-away view is shown of a further alternative embodiment side support 64, extension 66 and base member 68. The alternative embodiment side support 64 may be similar to the first side support 34 or second side support 36 discussed above, except that the alternative embodiment side support 64 may include a threaded end portion 70. The threaded end portion 70 may be threadably engageable with corresponding threads in a threaded opening 72 in the base member 68, or in a threaded opening 74 in the extension 66. The extension 66 may likewise include a threaded portion 76 that may be received in the threaded opening 72 in the base member 68, or in the threaded opening 74 in another extension 66. It will be understood that the side support 64, extension 66 and base member 68 may be used to provide an adjustable height to be compatible with mattresses 18 of varying heights. Accordingly, one or more extensions 66 may be added to the side support 64 such that the rail 42 may be raised and lowered to a desired height during use of the device 10. It will be understood that the extension 66 may be provided having various different lengths to allow the side support 64 to extend to any desirable height. Proper height of the side support 64 may allow the rail 42 to be raised adequately to form a space 44 of a desired size. Moreover, a side support 64 having a suitable height may allow the rail 42 to be lowered sufficiently to conform more closely to the mattress 18 such that the rail 42 may be less noticeable. Accordingly, the alternative embodiment of FIG. 8 may provide advantages of versatility, since it is known in the art that mattresses are commonly formed in various different height dimensions.

It will be appreciated that one embodiment of the present disclosure may be operated by manually raising or lowering the rail 42. Alternatively, it will be understood that mechanized equipment known to those skilled in the art may be utilized to operate the device 10. For example, a pneumatic pump may be utilized to raise and lower the rail 42. Alternatively, electric motors or any other motorized device may be used to operate the device 10. Moreover, the device 10 may be controlled remotely using any variety of remote control equipment known to those skilled in the art.

It will be understood that the device 10 and the components thereof may be constructed of any suitable material known to those skilled in the art. Materials may be selected having suitable strength and durability characteristics, including but not limited to metals, plastics, and composite materials. Likewise, any suitable method of manufacturing the device 10 known to those skilled in the art may be utilized.

It will be appreciated that the structure and apparatus disclosed herein is merely one example of a locking means for locking a support structure, and it should be appreciated that any structure, apparatus or system for locking a support structure which performs functions the same as, or equivalent to, those disclosed herein are intended to fall within the scope of a means for locking a support structure, including those structures, apparatus or systems for locking a support structure which are presently known, or which may become available in the future. Anything which functions the same as, or equivalently to, a means for locking a support structure falls within the scope of this element.

In accordance with the features and combinations described above, a useful method of forming a space under the covers of a bed includes the steps of:

(a) extending a base member across a width of the bed;

(b) positioning the base member at any desired location along a length of the bed;

(c) supporting a rail member with the base member; and (d) lifting the rail linearly in an upward direction to support the covers above the bed.

In accordance with the features and combinations described above, another useful method of forming a space under the covers of a bed includes the steps of:

(a) providing a substantially rectangular frame defining an enclosed space for receiving at least a portion of the bed there through, the substantially rectangular frame comprising a rail;

(b) positioning the rail between a mattress and the covers; and (c) lifting the rail linearly in an upward direction to support the covers above the bed.

In accordance with the features and combinations described above, an additional useful method of forming a space under the covers of a bed includes the steps of:

(a) extending a rail across a width of the bed from a first side of the bed to a second side of the bed, between the covers and a mattress, the rail being substantially flat so as to be unobtrusive under the covers;

(b) supporting the rail in an elevated position with respect to the mattress to form the space; and (c) lowering the rail to rest on the mattress so as to eliminate the space.

Those having ordinary skill in the relevant art will appreciate the advantages provided by the features of the present disclosure. For example, it is a feature of the present disclosure to provide a device that is simple in design and manufacture, for supporting covers in an elevated position on a bed. Another feature of the present disclosure is to provide such a device for supporting covers on a bed, that may be adjustable along the length of the bed such that bed covers may be elevated at different locations to be useful for people of different heights, or for use in elevating the bed covers over different portions of the body. It is a further feature of the present disclosure, in accordance with one aspect thereof, to provide a device for supporting covers on a bed that may be easily adjusted over a wide range of upward positions. It is another feature of the present disclosure to provide a device for supporting covers in an elevated position on a bed, that may be unobtrusive such that the device may be substantially hidden from view when not in use.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A device for supporting covers on a bed, said device comprising:

a base member configured to be positioned beneath a mattress on said bed, said base member having a first end configured to be positioned on a first side of said bed, and a second end configured to be positioned on a second side of said bed;

a first side support joined to said first end of said base member and a second side support joined to said second end of said base member;

a rail joined to said first side support and said second side support, said rail configured to reside above said mattress and under said covers on said bed for supporting said covers above said bed; and a locking mechanism on at least one of said first side support and said second side support, wherein said locking mechanism comprises a rotatable lever having a cam surface, said locking mechanism further comprising a grip member, wherein said locking mechanism is configured and arranged such that when said lever is rotated to a locking position, said cam surface contacts said grip member and forces said grip member against said at least one of said first side support and said second side support, and when said lever as rotated to an unlocked position, said cam surface releases said grip member such that said at least one of said first side support and said second side support is movable with respect to said grip member;

wherein said first side support and said second side support are adjustable in length and lockable in an infinite number of positions, and wherein said device is configured to be adjustably positioned along a length of said bed.

2. The device of claim 1, wherein said base member has a non-rounded cross-section to support said device against rolling.

3. The device of claim 2 wherein said base member comprises substantially flat upper and lower surfaces.

4. The device of claim 1, wherein said first side support and said second side support comprise telescoping members.

5. The device of claim 1, wherein said first and second side supports are each fixedly attached to said base and said rail.

6. The device of claim 1, wherein said device defines an enclosed, substantially rectangular perimeter.

7. The device of claim 1, wherein said base member has a non-rounded cross-section to support said device against rolling;

wherein said base member comprises substantially flat upper and lower surfaces;

wherein said base member comprises a one-piece rigid member;

wherein said first side support and said second side support comprise telescoping members;

wherein said first and second side supports are each attached to said base and said rail;

wherein said device defines an enclosed, substantially rectangular perimeter;

wherein said rail comprises a substantially flat member such that said rail is configured to be unobtrusive under said covers;

wherein said locking mechanism further comprises a brace member, and said lever is pivotally attached to said brace member;

wherein said grip member is movably disposed in a cavity in said brace member;

wherein said cam surface is shaped such that when said lever is in said unlocked position, a space is provided between said cam surface and said at least one of said first side support and said second side support to allow said grip member to move in said cavity; and wherein said base member comprises a base opening for receiving one of said first side support and said second side support therein.

8. The device of claim 1, wherein said first side support and said second side support each comprise a threaded portion, said threaded portion being engageable with a threaded opening in said base member and one or more extension members.

9. The device or claim 1, wherein said locking mechanism further comprises a brace member, and said lever is pivotally attached to said brace member.

10. The device of claim 9, wherein said grip member is movably disposed in a cavity in said brace member.

11. The device of claim 10, wherein said cam surface is shaped such that when said lever is in said unlocked position, a space is provided between said cam surface and said at least one of said first side support and said second side support to allow said grip member to move in said cavity.

12. A device for supporting covers on a bed, said device comprising:

a base member configured to be positioned on a bottom of a mattress on said bed, said base member having a first end configured to be positioned on a first side of said bed, and a second end configured to be positioned on a second side of said bed, said base member defining a lowermost portion of said device;

a first side support fixedly joined to said first end of said base member and a second side support fixedly joined to said second end of said base member;

a rail fixedly joined to said first side support and said second side support, said rail configured to reside above said mattress and under said covers on said bed for supporting said covers above said bed;

wherein said first side support and said second side support each comprise a telescoping member such that a length of said first side support and said second side support is adjustable; and one or more extensions removably attachable to said base member and said first and second side supports to further allow adjustment of a height of said device;

wherein said one or more extensions each comprise a portion receivable in an opening in said base, and said first and second side supports each comprise an end portion receivable in an opening in said extensions.

13. The device of claim 12, further comprising a locking mechanism on at least one of said first side support and said second side support.

14. The device of claim 13, wherein said locking mechanism comprises a lever having a cam surface for locking at least one of said first side support and said second side support.

15. The device of claim 14, wherein said locking mechanism further comprises a grip member for contacting said earn surface and at least one of said first side support and said second side support.

16. The device of claim 12, wherein said rail comprises a substantially flat member such that said rail is configured to be unobtrusive under said covers when said rail resides in a lowered position.

* * * * *